US007046108B2

(12) United States Patent
Lin

(10) Patent No.: US 7,046,108 B2
(45) Date of Patent: May 16, 2006

(54) ELECTRONIC CIRCUIT BREAKER WITH MAGNETIC MECHANISM

(76) Inventor: Tzo-Ing Lin, PMB#1008, 1867 Ygnacio Valley Rd., Walnut Creek, CA (US) 94598

( * ) Notice: Subject to any disclaimer, the term of this patent is extended or adjusted under 35 U.S.C. 154(b) by 0 days.

(21) Appl. No.: 10/843,331

(22) Filed: May 12, 2004

(65) Prior Publication Data

US 2005/0253674 A1 Nov. 17, 2005

(51) Int. Cl.
*H01H 67/02* (2006.01)

(52) U.S. Cl. ..... 335/132; 335/18

(58) Field of Classification Search ..... 335/6, 335/14, 18, 132, 165–179; 361/42–51
See application file for complete search history.

(56) References Cited

U.S. PATENT DOCUMENTS 3,855,502 A * 12/1974 Pardue et al. ..... 361/45
5,886,606 A * 3/1999 Tosaka et al. ..... 335/172
6,864,769 B1 * 3/2005 Germain et al. ..... 335/172

* cited by examiner

*Primary Examiner*—Lincoln Donovan
(74) *Attorney, Agent, or Firm*—Leong C. Lei

(57) ABSTRACT

An electronic circuit breaker which includes an automatic button or switch handle, a movable axle fitted in the automatic button, a movable copper mounted on a lower end of the movable axle, two movable silver contacts provided on two sides of a bottom of the movable copper, two stationary silver contacts positioned against the two movable silver contacts, a magnetic mechanism disposed between the two stationary silver contacts, the magnetic mechanism comprising a permanent magnet, two iron plates mounted at two sides of the permanent magnet, a reel mounted on one of the iron plates, a solenoid installed on the reel, a CPU connected with the solenoid, a primary circuitry conductive wire installed on the other one of the iron plates, a movable iron mounted on a bottom of the movable copper, a stationary magnet and CT connected in series with a primary circuitry of current-out and current-in electrodes, a movable magnet mounted above the stationary magnet, a short-circuit locking mechanism having an arm positioned on a route of the movable magnet.

4 Claims, 10 Drawing Sheets

ELECTRONIC CIRCUIT BREAKER WITH MAGNETIC MECHANISM

BACKGROUND OF THE INVENTION

1. Field of the Invention

This invention is related to an electronic circuit breaker with a magnetic mechanism, and in particular to one having a magnetic structure and current adjusting means and capable of interrupting a current in case of short circuits, and also capable of cooperating with telephone sets, voice system, keyboards, and software programs to form a remote telephone-controlled system.

2. Description of the Prior Art

The conventional circuit breaker generally adopts a mechanical structure such as levers, transmission mechanisms, and a temperature controlled mechanism to interrupt current automatically in case of overload, short-circuit or electricity leakage. After the trouble is removed, a button is moved manually to close the circuit of the circuit breaker again. However, the mechanical structure occupies a relatively large space so that the size of the circuit breaker cannot be reduced and thereby increasing the cost of manufacturing. Furthermore, the mechanical structure cannot provide a steady operation and will often break down. In case of failure, the circuit breaker cannot be restore automatically and it is necessary for an operator to trigger the circuit breaker manually. Moreover, the circuit breaker cannot be used for remote control and monitoring operation.

In case of short circuit, since the conventional circuit breaker does not have a locking function, the circuit breaker may be accidentally switched on thereby causing secondary damage, because there will be a large current flowing through the circuit breaker thus producing large electric arcs between the contacts of the circuit breaker and therefore easily causing harm to the user.

As to the overload protector utilizing bimetallic members or magnetic oil tube, since the bimetallic members are made of metal alloy, they will produce heat when current flows through them, thereby easily causing damage to the bimetallic plates. Furthermore, in a natural environment, the bi-metallic members are very sensitive to the temperature and so they will not be reliable in the situation where there is a big difference in temperatures. The accuracy and overload current value of the magnetic oil tube cannot be adjusted and the magnetic oil tube is complicated in manufacture and will emit noise when working.

Therefore, it is an object of the present invention to provide an improved electronic circuit breaker which can obviate and mitigate the above-mentioned drawbacks.

SUMMARY OF THE INVENTION

The primary object of the present invention is to provide an electronic circuit breaker with a magnetic mechanism, which is very compact in size as compared with the conventional circuit breaker. In comparison with the conventional circuit breaker, the volume of the present invention is only one-half that of the conventional circuit breaker with the same power. Furthermore, the present invention is more simple in structure and more reliable in operation than the conventional circuit breaker, and will automatically switch off in case of overload, electricity leakage, or short-circuit but will automatically restore its working condition when the trouble is removed thereby making it suitable for remote control. As the present invention has improved the complicated and bulky mechanical structure, the present invention will no longer have mechanical breakdown troubles thus largely lowering the cost and making it easier to use. After current flows through the primary circuitry of the electronic circuit breaker, no current will pass through the solenoid and the magnetic mechanism will keep the circuit breaker working normally thereby saving the electric energy consumed by the solenoid and reducing noise. The locking mechanism will prevent the circuit breaker from working in case a short-circuit occurs so as to prevent the generation of electric arcs which will cause damage. Only when the breakdown trouble is removed can the circuit breaker work again. The current controller can keep large power in the same volume and weight thus ensuring the working reliability and making it suitable for a larger scope of temperature difference. Moreover, the present invention can be applied to a remote telephone control system and can simplify the structure, lower the cost, and provide more functions for practical use.

According to the present invention, an electronic circuit breaker comprises an automatic button or switch handle, a movable axle fitted in the automatic button, a movable copper mounted on a lower end of the movable axle, two movable silver contacts provided on two sides of a bottom of the movable copper, two stationary silver contacts positioned against the two movable silver contacts, a magnetic mechanism disposed between the two stationary silver contacts, the magnetic mechanism comprising a permanent magnet, two iron plates mounted at two sides of the permanent magnet, a reel mounted on one of the iron plates, a solenoid installed on the reel, a CPU (central processing unit) connected with the solenoid, a primary circuitry conductive wire installed on the other one of the iron plates, a movable iron mounted on a bottom of the movable copper, a stationary magnet and CT (current sensor also called current transformer) connected in series with a primary circuitry of current-out and current-in electrodes, a movable magnet mounted above the stationary magnet, a short-circuit locking mechanism having an arm positioned on a route of the movable magnet, the arm having an end connected with an engaging member which is connected with a restoration spring at one end and with the movable axle at the other end.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
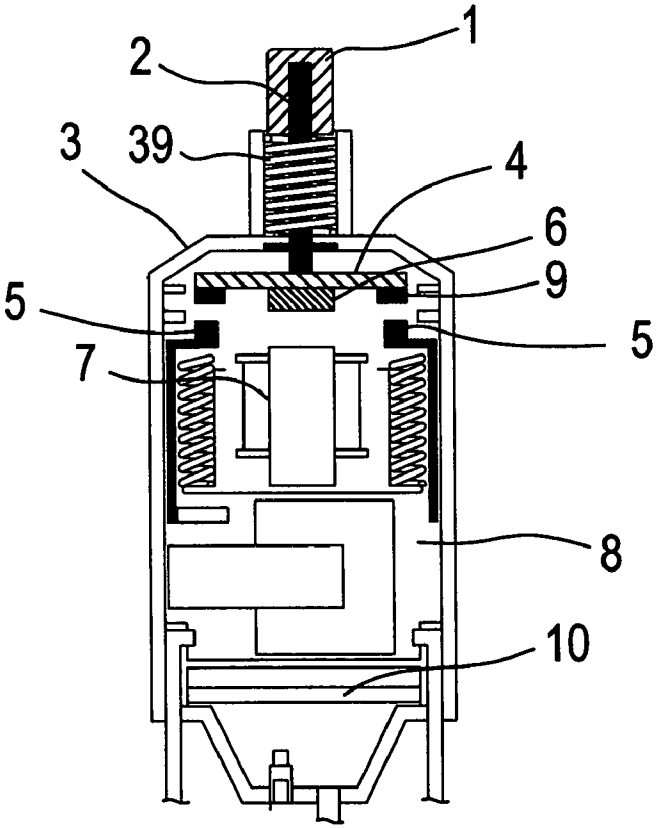
FIG. 1 illustrates the working principle of the magnetic mechanism of the electronic circuit breaker according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
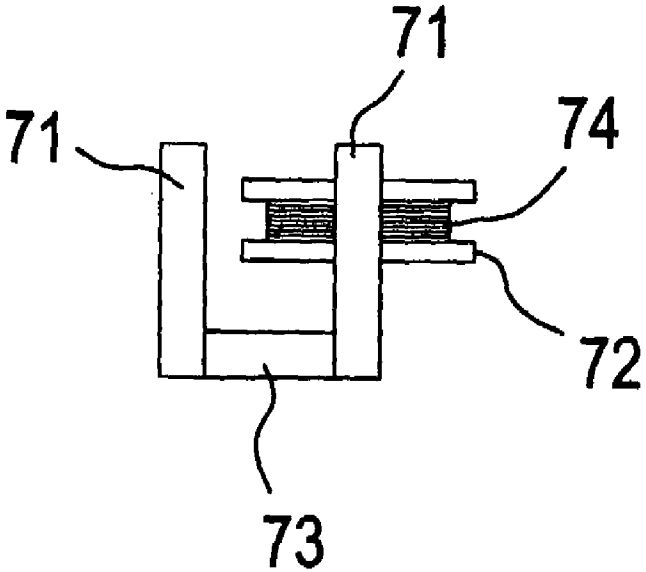
FIG. 2 illustrates the structure of the magnetic mechanism of the electronic circuit breaker according to the present invention.

FIGS. 1 and 2 illustrate the working principle and structure of the magnetic mechanism of the electronic circuit breaker according to the present invention, respectively. As shown, the electronic circuit breaker according to the present invention mainly comprises a housing 3, a button 1 mounted on the top of the housing 3, a movable axle 2 having an upper end fitted into the bottom of the button 1, a restoration spring 39 fitted over the movable axle 2, a movable copper 4 mounted within the housing 3 and having an upper side in contact with the lower end of the movable axle 2, two movable silver contacts 9 provided at two sides of the bottom of the movable copper 4, a movable iron 6 provided on the center of the bottom of the movable copper, two stationary silver contacts 9 mounted within the housing 3 and positioned under respective movable silver contacts 9 and connected to the power supply via two flexible copper wires 8, and a magnetic mechanism 7 mounted at the central portion of the housing 3. The magnetic mechanism 7 comprises a pair of iron plates 71, a reel 72 mounted on one of the iron plates 71, a permanent magnet 73 mounted between the two iron plates 71, a solenoid 74 installed on the reel 72. The opening and closing of the circuit of the coil 74 is controlled by a CPU circuit board 10.

When no electric current passes through the solenoid 74, the permanent magnet 7 cannot attract the movable iron 6 on the movable copper 4 because the permanent magnet 7 is too far from the movable iron 6. Hence, the movable axle 2 is kept stationary, the button 1 does not move downwards, and the movable silver contacts 9 do not get in touch with the stationary silver contacts 5, so that the electronic circuit breaker is not connected with the power supply and is not working. When the solenoid 74 receives instructions from the CPU to close the circuit, the solenoid 74 will be connected with the power supply and the iron plates 71 will be magnetized thus attracting the movable iron 6 on the movable copper 4 to go downwardly and therefore pulling down the movable axle 2 to compress the spring 39. As a consequence, the movable silver contacts 9 get in touch with the stationary silver contacts 5 thereby connecting the electronic circuit breaker with the power supply to enable the electronic circuit breaker to work. Then, the CPU will give instructions to open the circuit of the solenoid 74 so as to cut off the power supplied to the solenoid 74 thereby making the iron plates 71 lose magnetism and therefore releasing the movable iron 6. However, since the movable iron 6 is moved downward to approach the permanent magnet 73, the movable iron 6 will be attracted by the permanent magnet 73 so that the movable silver contacts 9 are kept in contact with the stationary silver contacts 5 thereby keeping the electronic circuit breaker to work. When the electronic circuit breaker is overloaded or short-circuited, the CPU will give an instruction to connect the solenoid 74 to the power supply in an opposite direction thus providing the iron plate 71 with an opposite polarity and canceling the attraction force from the permanent magnet 73. Hence, the movable iron 6 is longer attracted to go downwardly so that the spring 39 will restore to push the movable axle 2 together with the movable copper 4 and the movable iron 6 to go upwardly thereby separating the movable silver contacts 9 from the stationary silver contacts 5. As a result, the electronic circuit breaker is not working.

From the above, it is understood that the present invention may provide remote control and operation for an electronic circuit breaker.

Figure 3:
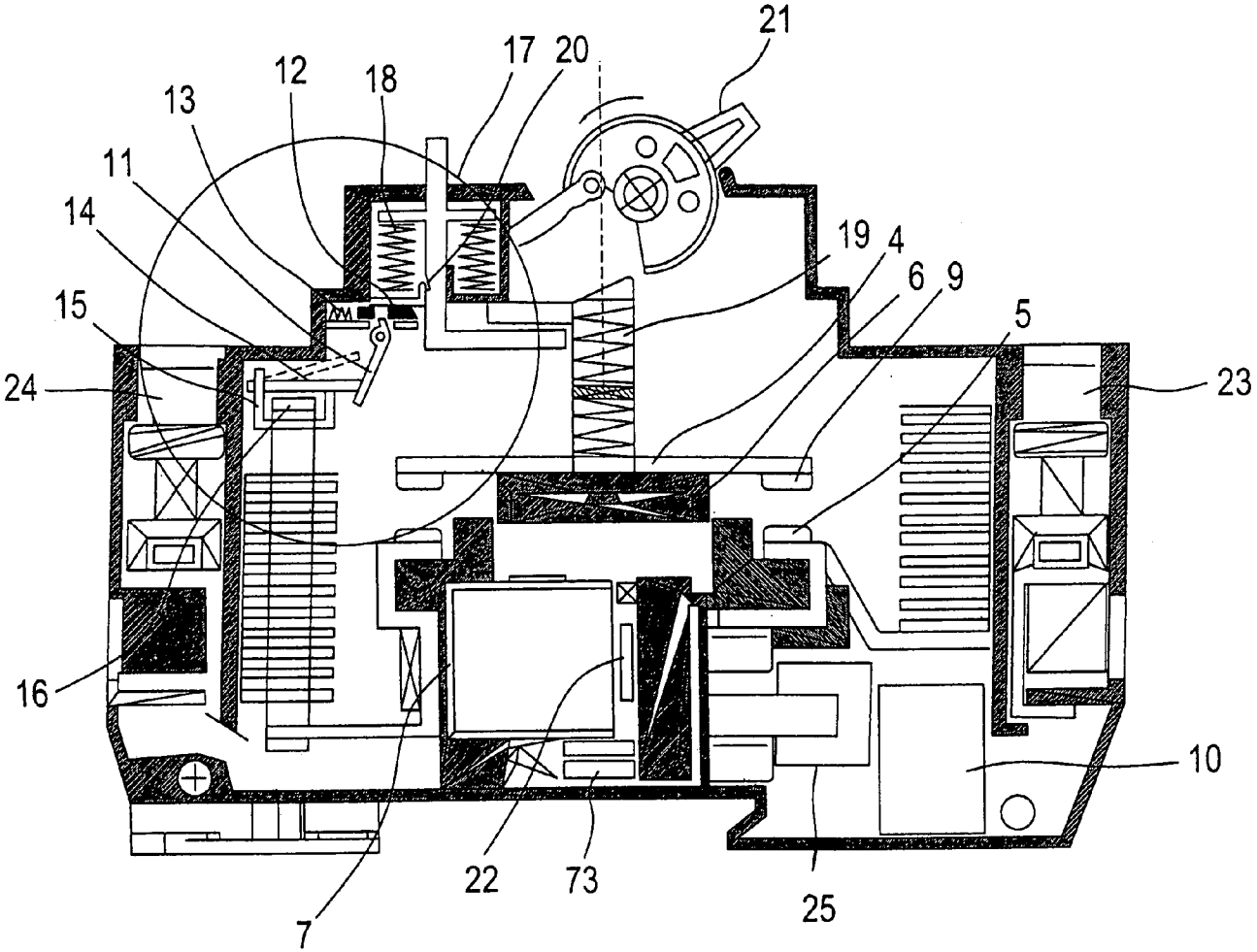
FIG. 3 illustrates the working principle of the electronic circuit breaker according to the present invention.
Figure 4:
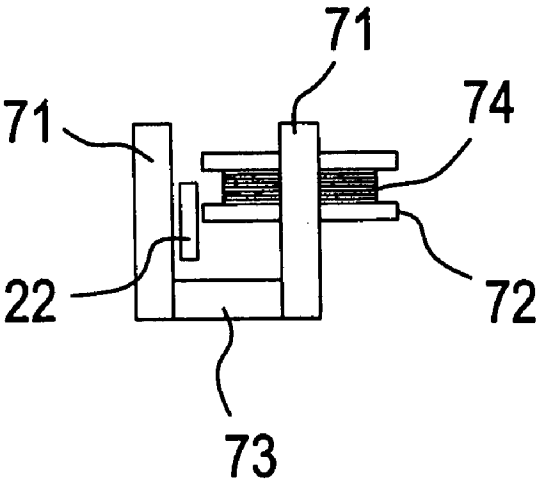
FIG. 4 is illustrates the structure of the magnetic mechanism and the iron of the electronic circuit breaker according to the present invention.

FIGS. 3 and 4 illustrate the working principle of the electronic circuit breaker with the magnetic mechanism and the structure of the magnetic mechanism, respectively. As shown, the electronic circuit breaker is switched off and the movable copper 4 is located at its upper position and the movable silver contacts 9 are separated from the stationary silver contacts 5, so that the circuit from the first electrode 24, the stationary silver contact 5, the movable silver contact 9 and the primary circuitry conductive wire 16 to the second electrode 23 is cut off thereby making the circuit breaker unable to work.

When the circuit breaker is in a normal condition, the locking rod 17 is pushed downwardly until the notch 20 of the locking rod 17 is aligned with an engaging member 12. Meanwhile, the engaging member 12 is urged by a spring 13 to engage with the notch 20. The engaging member 12 is connected with an end of a rotating arm 11 which is pivotally mounted in the circuit breaker. When the arm 11 is rotated clockwise, the movable magnet 14 will be moved to a position shown in dotted lines thereby separating the movable magnet 14 from the stationary magnet 15. Then, the handle 21 is rotated counterclockwise to push down the main body 19 thereby moving down the movable copper 4 and making the two movable silver contacts 9 get in touch with the two stationary silver contacts 5. Hence, the circuit through the first electrode 24, the copper wire 22, the stationary silver contacts 5, the movable silver contacts 9, the primary circuitry wire 16 and the second electrode 23 is closed thereby enabling the circuit break to function properly. In the meantime, the permanent magnet in the magnetic mechanism 7 attracts the movable iron 16 thus making the movable silver contacts 9 get in touch with the stationary silver contacts 5. The copper wire 22 will produce a certain amount of magnetism when the circuit breaker is working normally. By means of experiments, the number of loops of the copper wire 22 with neglectable magnetism produced in normal working can be calculated. The magnetism produced by the primary circuitry wire 16 will not have any influence on the movable iron 14. When the primary circuitry is short-circuited, there will be a large current in the circuitry so that a large magnetism will be generated in the copper wire 22 and the iron plate between the permanent magnet 73 and the movable iron 6 thereby producing an anti-force canceling the attraction force from the permanent magnet 73 to the movable iron 6. The main body 19 is sprung upwardly by the restoration spring thereby separating the movable silver contacts 9 from the stationary silver contacts 5 and opening the primary circuitry and therefore making the circuit breaker unable to work properly. In the case of a short circuit occurring, the primary circuitry wire 16 will produce a large magnetism to make the movable silver contacts 9 get in touch with the stationary silver contacts 5 thereby rotating the arm 11 clockwise. The engaging member connected to the other end of the arm 11 will withdraw from the notch 20 of the locking rod 17 and the spring 18 will pull the locking rod 17 to spring upwardly.

Figure 5:
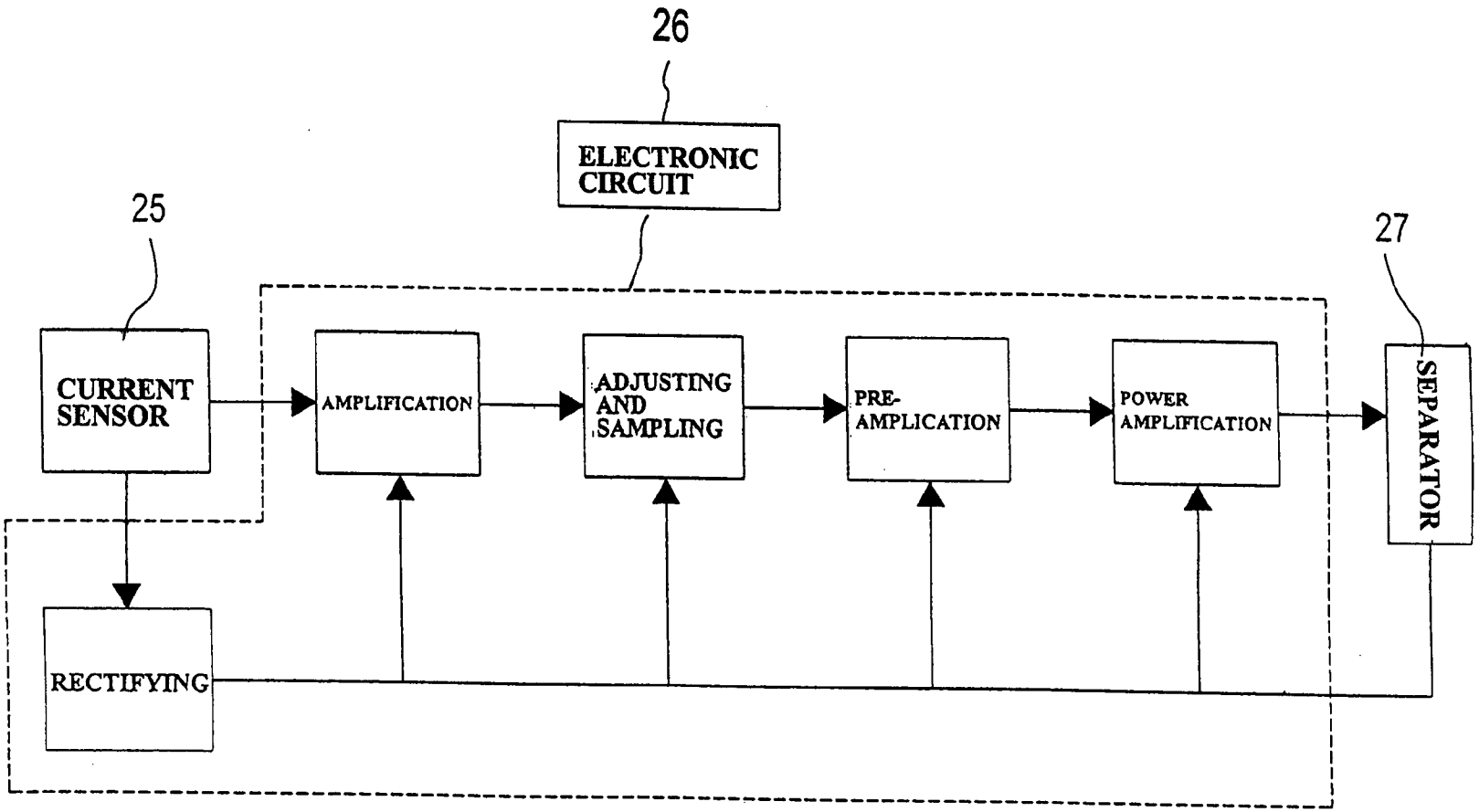
FIG. 5 is a block diagram of the current controller according to the present invention.
Figure 6:
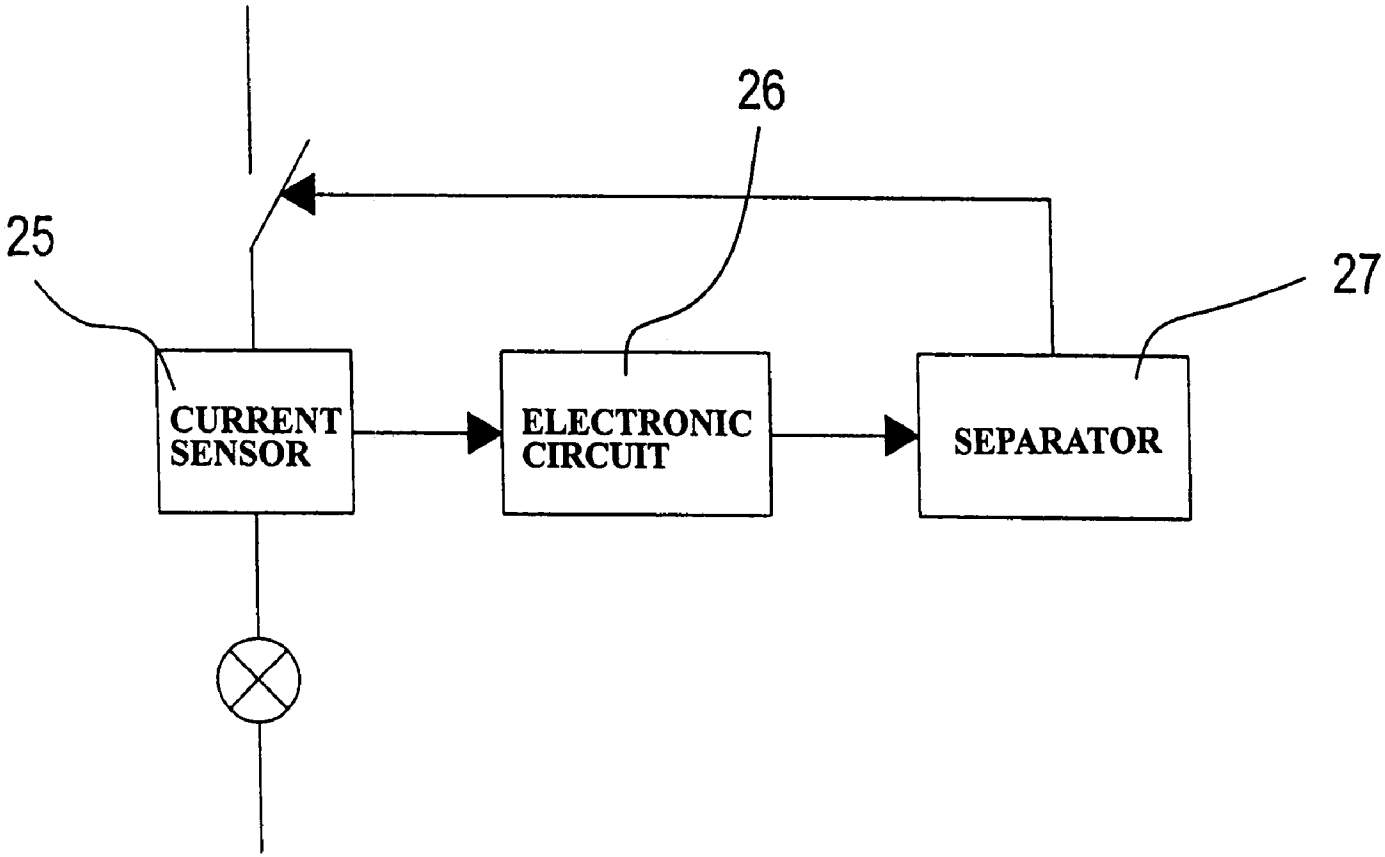
FIG. 6 illustrates the working principle of the current controller according to the present invention.

FIGS. 5 and 6 illustrate the block diagram and working diagram of the electronic circuit breaker with the magnetic mechanism according to the present invention. As shown, the current sensor 25 will transmit the picked-up signal to the electronic circuit 26 for form amplification, adjustment and sampling, pre-amplification and power amplification and then transmit to the separator 27. The rectified wave output from the current sensor 25 is connected to various portions of the electronic circuit 26.

Figure 7:
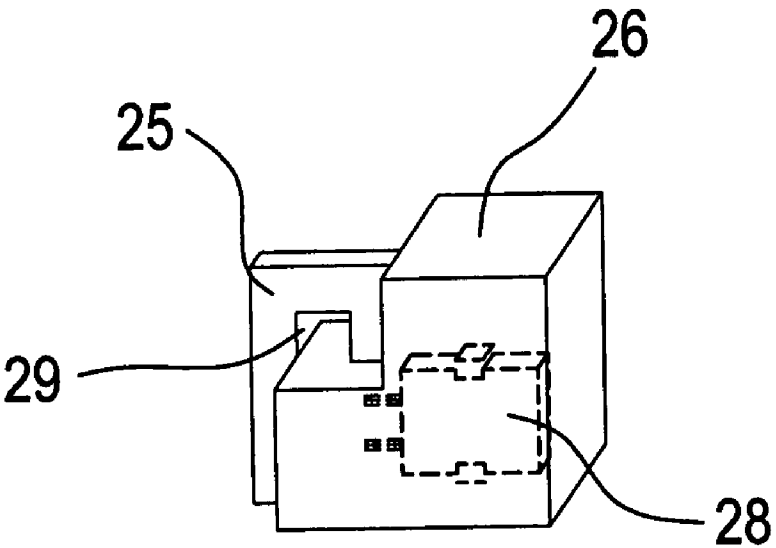
FIG. 7 illustrates the installation structure of the current controller according to the present invention.

FIG. 7 shows the installation of the electronic circuit breaker with the magnetic mechanism utilizing a current controller according to the present invention. As shown, the circuit board of the electronic circuit 26 and the current sensor 25 are mounted within the same housing and a current adjusting block 28 is used for adjusting the sensed overload current value.

In normal operation, the current will not be overloaded, but when the current is overloaded, the current sensor 25 will sense the overload current from the electrical wire passing through the primary circuitry wire passing hole 29 and then transmit the signal to the electronic circuit 26 for shaping and amplifying, adjusting and sampling, pre-amplifying and power amplifying and then transmit to the separator 27. The separator 27 will cut off the current to the circuitry thereby preventing the electrical device from being damaged.

Various portions of the present invention are designed for eliminating various kinds of breakdown including overload and short-circuit of the circuit breaker in working.

FIGS. 3, 8, 9, 10 and 10A illustrate the structure, flow chart, schematic view, front view and side view of the present invention. As shown, the remote telephone control system consists of the circuit breaker 34, the input line 31 of the telephone set 30, the voice system, the keyboard 37, the telephone control module 33 and the display 38 and can be used for controlling electrical devices 36. The input line 31 of the telephone set 30 is connected to the telephone control module 33, the voice system and the keyboard 37 and the display 38, and the output line of the telephone set 30 is to the CPU circuit board 10 of the circuit breaker 34 which controls the copper wire 74. The magnetic mechanism of the circuit breaker is connected to the power supply 35 which is connected to the telephone set 36 (the terminal subscriber is represented by dotted lines).

Figure 8:
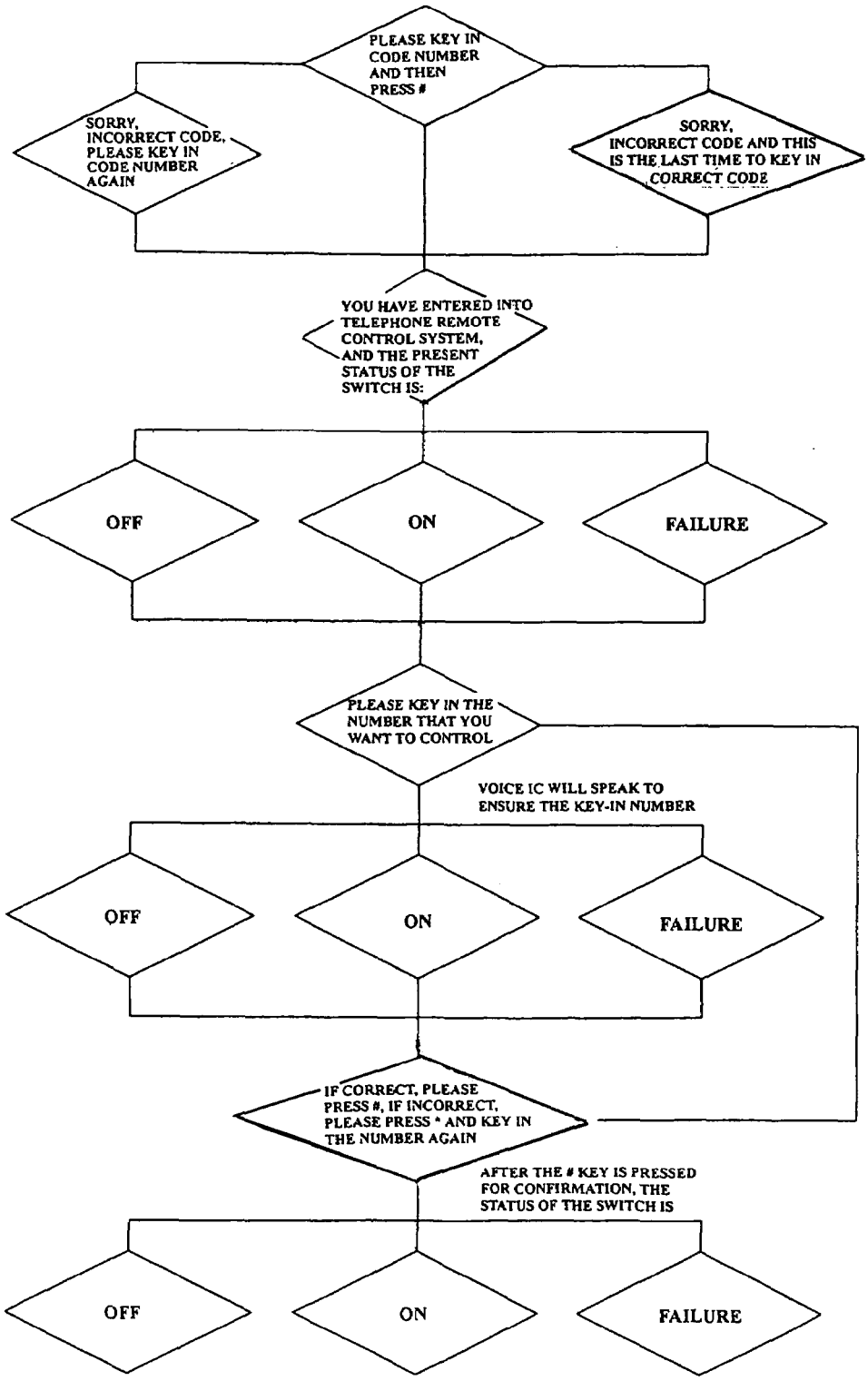
FIG. 8 is a flow chart of a remote telephone control system according to the present invention.
Figure 9:
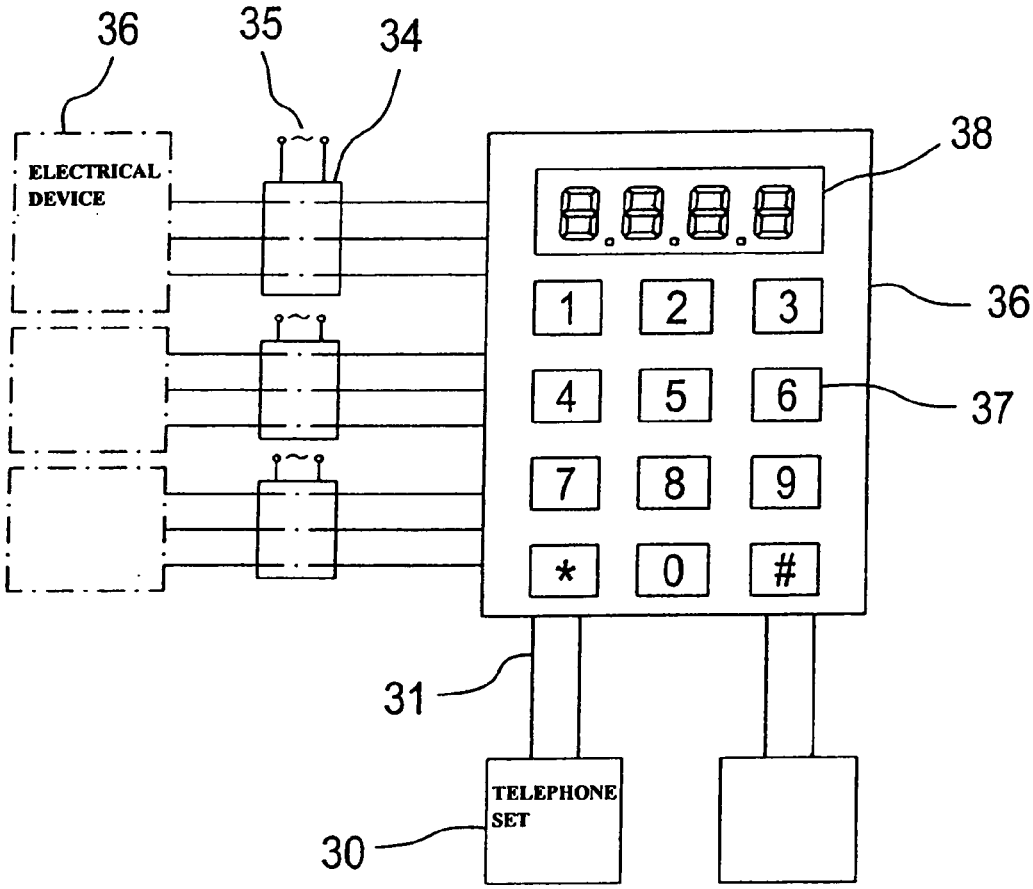
FIG. 9 illustrates the connection between the electrical device and the remote telephone control system.

When there is an incoming call, it will be processed according to the flow chart as shown in FIG. 8. To use remote control for the electrical device 36, a code can be keyed in and then the device will operate according to FIG. 8. If In order to turn on the electrical device 36, the voice system and the telephone control module 33 will process the signal and transmit the signal to the CPU circuit board 10 of the circuit breaker 34. The CPU circuit board 10 controls the conduction of the copper wire 74 to attract the movable iron 6 so as to make the movable silver contacts 5 get in touch with the stationary silver contacts 5 thereby closing the primary circuitry of the first electrode 24, the iron 22, the stationary silver contacts 5, the movable silver contacts 9, conductive wires 16 and the second electrode 23. Then, the electrical device controlled by the circuit breaker begins to work. As the circuit breaker is working normally, the CPU circuit board 10 will send out an instruction to open the circuit of the copper wire 74 thereby cutting off the current flowing through. Hence, the iron 71 will lose magnetism and cannot attract the movable iron 6, but since the movable iron 6 is moved down to approach the permanent magnet 73, the permanent magnet 73 will attract the movable iron 6. The electrical device is turned off by the software program. The voice system and the telephone control module 33 will transmit the processed signal to the CPU circuit board 10 of the circuit breaker 34. The CPU circuit board 10 controls the conduction of the solenoid 74 and the solenoid 74 is connected with the power supply in an opposite polarity so that the solenoid 74 will produce an opposite polarity thereby canceling the attraction force from the permanent magnet 73 to the movable iron 6. Hence, the movable iron 6 will not be attracted and under the pulling force of the restoration spring, the movable axle 2 will move the movable copper 4 and the movable iron 6 to spring away thereby separating the movable silver contacts 9 from the stationary silver contacts 5. As a consequence, the circuit breaker and the electrical device will not work.

To control a number of electrical devices 36, it is only necessary to increase a corresponding number of circuit breakers 34 for controlling air conditioners, water heaters, burglar-proof doors, lights, pet feeders, or the like.

Figure 10A:
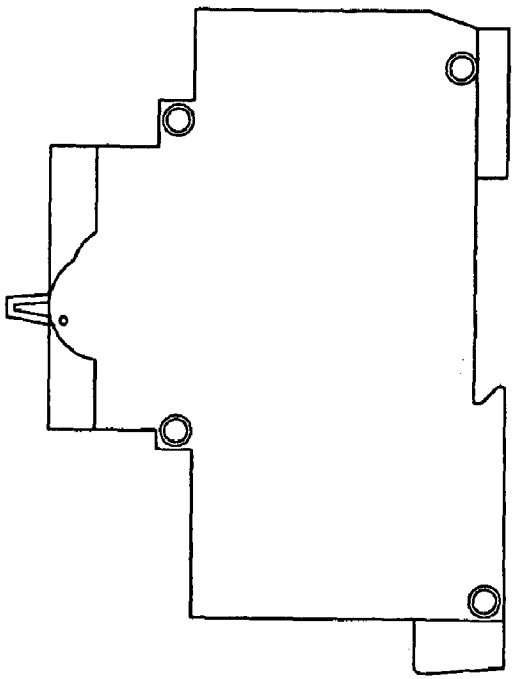
FIG. 10A is a side view of the present invention.
Figure 10:
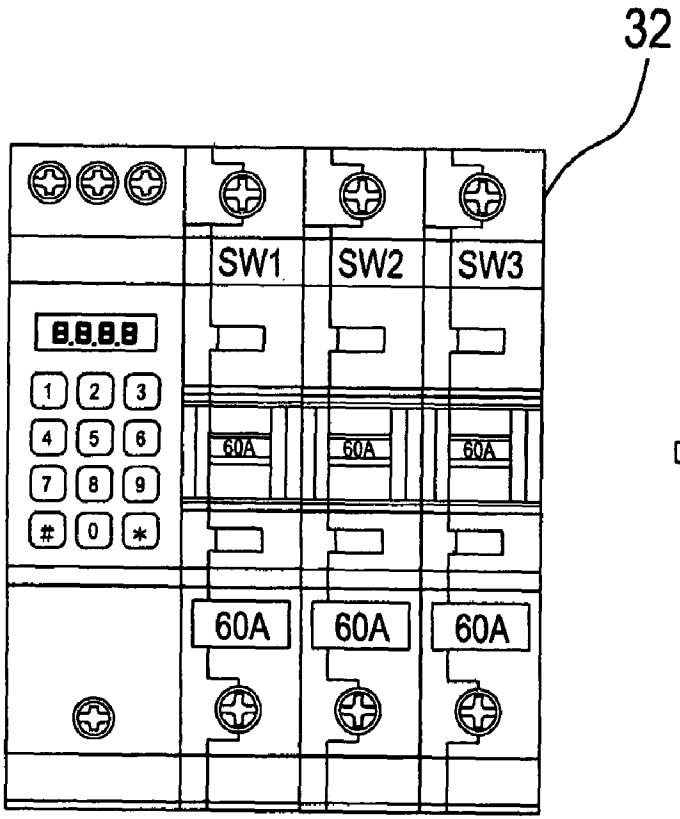
FIG. 10 is front view of the present invention.

The circuit breaker with the magnetic mechanism according to the present invention can be connected to the remote telephone control system (receiving portion) to form a control device 32. As shown in FIG. 10, the input end is directly connected to the power supply and the output end is connected to the electrical device 36. Then, the telephone input line 31 is connected to the telephone circuit to achieve the controlling purpose.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An electronic circuit breaker comprising an automatic button or switch handle, a movable axle fitted in said automatic button, a movable copper mounted on a lower end of said movable axle, two movable silver contacts provided on two sides of a bottom of said movable copper, two stationary silver contacts positioned against said two movable silver contacts, a magnetic mechanism disposed between said two stationary silver contacts, said magnetic mechanism comprising a permanent magnet, two iron plates mounted at two sides of said permanent magnet, a reel mounted on one of said iron plates, a solenoid installed on said reel, a CPU connected with said solenoid, a primary circuitry conductive wire installed on the other one of said iron plates, a movable iron mounted on a bottom of said movable copper, a stationary magnet and CT connected in series with a primary circuitry of current-out and current-in electrodes, a movable magnet mounted above said stationary magnet, a short-circuit locking mechanism having an arm positioned on a route of said movable magnet, said arm having an end connected with an engaging member which is connected with a restoration spring at one end and with said movable axle at the other end.

2. The electronic circuit breaker as claimed in claim 1, further comprising a separator and a current adjusting block wherein the current sensor will transmit the CT signal to the electronic circuit for rectification and amplification, adjustment and sampling, pre-amplification and power amplification and then transmit to said separator, CT and the electronic circuit board being mounted within a casing.

3. The electronic circuit breaker as claimed in claim 1, wherein said circuit breaker can be associated with telephone sets, voice system, keyboards and software programs to form a remote telephone control system, said voice system and telephone control portion transmitting processed signal to a CPU circuit board for controlling output to said solenoid of said circuit breaker, said circuit breaker having a current-in electrode connected to a power supply and a current-out electrode connected to an electrical device.

4. The electronic circuit breaker as claimed in claim 1, wherein said magnetic mechanism comprises a permanent magnet, two iron plates mounted at two sides of said permanent magnet, a reel mounted on one of said iron plates, a solenoid installed on said reel, a CPU connected with said solenoid, a primary circuitry conductive wire installed on the other one of said iron plates, a movable iron mounted on a bottom of said movable copper.

* * * * *